US006109687A

United States Patent [19]

Nye et al.

[11] Patent Number: 6,109,687

[45] Date of Patent: Aug. 29, 2000

[54] NESTED, INDEPENDENTLY DEPLOYABLE BENCH AND TABLE APPARATUS AND METHOD

[75] Inventors: Stephen F. Nye, Roy; Lynn C. Strong, Clearfield, both of Utah

[73] Assignee: Lifetime Products, Inc., Clearfield, Utah

[21] Appl. No.: 09/150,448

[22] Filed: Sep. 9, 1998

[51] Int. Cl.[7] ..... A47B 3/14

[52] U.S. Cl. ..... 297/158.4; 297/139; 297/140; 297/159.1

[58] Field of Search ..... 297/158.4, 159.1, 297/158.3, 158.5, 139, 140; 108/35, 36

[56] References Cited

U.S. PATENT DOCUMENTS

| | | | |
|---|---|---|---|
| Re. 18,207 | 9/1931 | Soltesz | 108/35 X |
| D. 243,043 | 1/1977 | Rogers | D6/337 |
| D. 327,779 | 7/1992 | Jansen et al. | D6/337 |
| D. 369,912 | 5/1996 | Noll | D6/337 |
| 2,109,869 | 3/1938 | Ross | 155/123 |
| 2,279,122 | 4/1942 | Kovalchuk | 108/35 |
| 2,452,169 | 10/1948 | Wells | 155/123 |
| 2,522,642 | 9/1950 | Schmidt | 155/124 |
| 2,524,198 | 10/1950 | La Rue | 155/123 |
| 2,568,622 | 9/1951 | Hagan | D6/337 |
| 2,579,934 | 12/1951 | Krasney | 311/83 |
| 2,647,562 | 8/1953 | Hoffar | 155/124 |
| 2,721,778 | 10/1955 | Wilson | 297/158.4 |
| 2,748,837 | 6/1956 | Beller | 155/124 |
| 2,752,987 | 7/1956 | Smithers | 155/124 |
| 2,811,197 | 10/1957 | Nimmo | 155/124 |
| 2,825,390 | 3/1958 | Post | 155/124 |
| 3,028,197 | 4/1962 | Wilson | 297/239 |
| 3,262,734 | 7/1966 | Kuks | 297/158.3 |
| 3,273,936 | 9/1966 | Deavers | 297/159 |
| 3,276,815 | 10/1966 | Cardy | 297/159 |
| 3,574,393 | 4/1971 | Hughes . | |
| 3,580,632 | 5/1971 | Seymour | 297/158.4 |
| 3,672,719 | 6/1972 | Haukedahl | 297/118 |
| 3,885,829 | 5/1975 | Haeger . | |
| 3,994,527 | 11/1976 | Nikitits et al. . | |
| 4,047,754 | 9/1977 | Cathey | 297/158.3 |
| 4,052,100 | 10/1977 | Nikitits et al. | 297/159 |
| 4,064,812 | 12/1977 | Commanda | 108/36 |
| 4,111,482 | 9/1978 | Jones . | |
| 4,131,311 | 12/1978 | Nikitits et al. . | |
| 4,330,151 | 5/1982 | Healey | 297/158.3 |
| 4,537,443 | 8/1985 | Bray . | |
| 4,653,804 | 3/1987 | Yoo et al. . | |
| 4,826,244 | 5/1989 | Choi . | |
| 4,883,314 | 11/1989 | Sakong . | |
| 5,314,231 | 5/1994 | Otterbacher | 297/159 |
| 5,752,450 | 5/1998 | Roesner | 297/157.1 |

FOREIGN PATENT DOCUMENTS

| | | |
|---|---|---|
| 49-3062 | 10/1967 | Japan . |
| 48-9858 | 2/1973 | Japan . |
| 50-84303 U | 12/1973 | Japan . |
| 3025644 U | 11/1995 | Japan . |

OTHER PUBLICATIONS

"Portable Table and Chair Set" informational brochure, Brookstone®, Nashua, New Hampshire.

*Primary Examiner*—Anthony D. Barfield
*Attorney, Agent, or Firm*—Madson & Metcalf

[57] ABSTRACT

A portable, storable table and bench system may be collapsed and nested. Benches may nest within the envelope of the table. Benches may be deployed independently from the table. The table may be deployed independently from the benches. The table may be deployed, with the benches maintained in nested storage within the table envelope, without requirement to deploy the benches. Tables may be formed by several suitable methods including fabrication from wood, framing with metal and wood, blow molding, tumble molding, vacuum forming, and the like. Cavities in the table for nesting the bench may fit within the envelope or cross-section of the table, or may be formed as recesses in outside surfaces underneath the table top.

34 Claims, 14 Drawing Sheets

NESTED, INDEPENDENTLY DEPLOYABLE BENCH AND TABLE APPARATUS AND METHOD

BACKGROUND

1. The Field of the Invention

This invention relates to recreational furniture, and more particularly to tables and benches for collapsed storage or for portable recreational use.

2. The Background Art

Seating and tables have been the subject of numerous designs in furniture over millennia. Furniture within homes, offices, and other places of meeting may be large, heavy, unwieldy, and may even be assembled in-place. However, another class of seating and tables exists.

Portable, or storable, tables and seating have been used for decades if not centuries. Stools, foldable assemblies, drop-down work spaces (tables, workbenches), and so forth have been the subject of many designs. Banquet tables are often manufactured to be readily collapsible in order to facilitate rapid setup and takedown, storage, moving, and the like.

Similarly, recreational tables have been developed over many years. Recreational tables may be fixed in place. For example, concrete, wood, metal, and the like have been used as the frames, top surfaces, and so forth in tables. Durability has been a major factor in the construction of recreational tables for outdoor use. To a lesser extent, portability has become a factor in the design and construction of recreational tables.

Tables are frequently used in conjunction with chairs. Typically, benches are more efficient than chairs in the ability to seat numerous persons at a table. However, benches need stability. Moreover, benches tend to be quite heavy. An individual chair may be made in a size and weight to be readily transportable, foldable (collapsible), storable, and the like. By contrast, a bench becomes an article of a size similar to that of a table. Moreover, stability often dictates a size or weight that is not readily adaptable to be portable or storable.

Tables have become more portable, collapsible, storable, and the like in more recent years. However, most systems for picnic-type tables are not collapsible, readily storable, lightweight, or the like. Certain small systems have become prevalent in recent years. However, the size and utility of such collapsible systems has been marginal.

Storage is a matter of space, weight, and the availability of people to store and deploy equipment. Tables that are too large become difficult to store without the use of several people. Moreover, storage of tables, benches, chairs, etc., may demand substantial space.

What is needed is a readily storable, collapsible table system having seating integrated therein. For example, it would be advantageous to have a table with a bench integrated within the table. Preferably, the bench could remain within the envelope (projected area or space requirement) of the table when stored. Likewise, it would be advantageous to have a bench that may remain nested within a table during storage.

In certain situations, tables are used for serving, display, and the like. In such situations, seating is not required. Nevertheless, a table that is integrated with a bench or other seating typically deploys to space the seating somewhat away from the table itself. Accordingly, such a table tends to be heavy, bulky, and keeps viewers or passersby a distance away from the table. Accordingly, a table used for display or serving is not easily viewed with attached benches deployed at knee or shin level for a passerby, keeping such passersby away from the table top.

What is needed is a table that is collapsible but capable of containing its own seating. Moreover, it would be advantageous if the seating could be selectively deployed or stored within the envelope of the table without effecting the ability of the table to be used without deployment of the benches.

Also, it would be advantageous to have the benches separable from the table. For example, although benches and tables are often used in conjunction with one another, it may be advantageous to use benches independently from the table. Accordingly, it would be advantageous to be able to remove benches from the table for placement in another desirable location.

For example, around a campfire, or other recreational center of activity, a bench may be necessary or desirable. If benches must remain attached to a table in order for either one or both to be functional, then freedom to move the benches to a more desirable location is substantially limited. It would be advantageous in the art to have a table that may be deployed independently from its benches. Nested storage whether during transportation, or storage during the actual independent deployment of the table alone with the benches unneeded, would be a substantial advantage. Such a system in a size to be functionally equivalent to a banquet table, and of a weight suitable for portability would be very desirable.

BRIEF SUMMARY AND OBJECTS OF THE INVENTION

In view of the foregoing, it is a primary object of the present invention to provide a readily collapsible table and bench system that is completely nested within the envelope of the table. In one embodiment, a table may contain legs secured to pivot from an end of a table. For example, a pedestal may be formed having one or more legs extending from a frame of a table to a foot for placement on a surface. The pedestal or legs may extend from an end of a table toward the ground or surface for supporting the table.

Alternatively, the pedestal or legs may extend from the table, or an underside thereof, at a point spaced away from the end of the table. For example, banquet tables may advantageously have additional access for persons to sit at the end thereof if a table leg or pedestal is spaced away from the end of the table. Accordingly, in one embodiment, a table and bench system may be constructed to have a leg or pedestal extending away from the table toward a supporting surface, but secured at a distance spaced from an end of a table and designed to permit seating of a user at the end of the table.

Consistent with the foregoing objects, and in accordance with the invention as embodied and broadly described herein, an apparatus and method are disclosed, in suitable detail to enable one of ordinary skill in the art to make and use the invention. In certain embodiments an apparatus and method in accordance with the present invention may include an upper surface formed of wood, plastic, or other material selected for weight, strength, and the like.

Moreover, the table may have reinforcement by way of a stringer or rail in order to improve the section modulus, stiffness and strength of the table. Benches may also have stringers or rails extending therealong. In an alternative embodiment, the section modulus of the table, or bench, or both may be improved by changing the thickness or width of the principal body thereof in order to obtain structural materials spaced as far as possible from the neutral axis (extend the outermost fiber). As a practical matter, the legs or pedestals of the table and bench, as well as the feet associated with those pedestals, may be formed of metal, and may be designed to have a tubular cross-section for improving strength while minimizing weight.

A system of latches, detents, and the like may be formed along an underside of the table in order to latch the benches into place, secure the legs of the benches and the legs of the table to remain secured against the underside of the table, and so forth.

The table and benches may be formed of wood, metal, such as extrusions or expanded metal, whether steel or aluminum, and the like. Moreover, the tables, benches, or both may be fabricated of certain plastics, for example, the table top and the bench tops may be formed of blow-molded or vacuum formed polymeric resins. Alternatively, large expanses of sophisticated cross-section may be formed in a tumble-molding operation. The section modulus of the table may be improved by blow molding or tumble molding.

Also, in certain embodiments, the tables, bench, or both may be filled with expanded polymeric materials, such as expanded polystyrene or expanded urethane in order to protect against bucking failure of hollow sections. In other embodiments, the wall thickness of a plastic table or plastic bench may be substantially increased to provide sufficient stiffness and strength without interior stiffeners such as expanded plastics or polymers or with fewer stiffeners.

BRIEF DESCRIPTION OF THE DRAWINGS

The foregoing and other objects and features of the present invention will become more fully apparent from the following description and appended claims, taken in conjunction with the accompanying drawings. Understanding that these drawings depict only typical embodiments of the invention and are, therefore, not to be considered limiting of its scope, the invention will be described with additional specificity and detail through use of the accompanying drawings in which:

FIG. 12 is a perspective view of one alternative embodiment for a bracket and axle for pivoting a leg of a pedestal for a table, bench, or the like;

FIGS. 14A–14E illustrate selected, alternative embodiments for mechanisms to lock legs, pedestals, feet, and the like in place for benches, tables, and the like.

DETAILED DESCRIPTION OF THE PREFERRED EMBODIMENTS

It will be readily understood that the components of the present invention, as generally described and illustrated in the Figures herein, could be arranged and designed in a wide variety of different configurations. Thus, the following more detailed description of the embodiments of the system and method of the present invention, as represented in FIGS. 1 through 14A–E is not intended to limit the scope of the invention. The scope of the invention is as broad as claimed herein. The illustrations are merely representative of certain, presently preferred embodiments of the invention. Those presently preferred embodiments of the invention will be best understood by reference to the drawings, wherein like parts are designated by like numerals throughout.

Those of ordinary skill in the art will, of course, appreciate that various modifications to the details of the Figures may easily be made without departing from the essential characteristics of the invention. Thus, the following description of the Figures is intended only by way of example, and simply illustrates certain presently preferred embodiments consistent with the invention as claimed.

Figure 1:
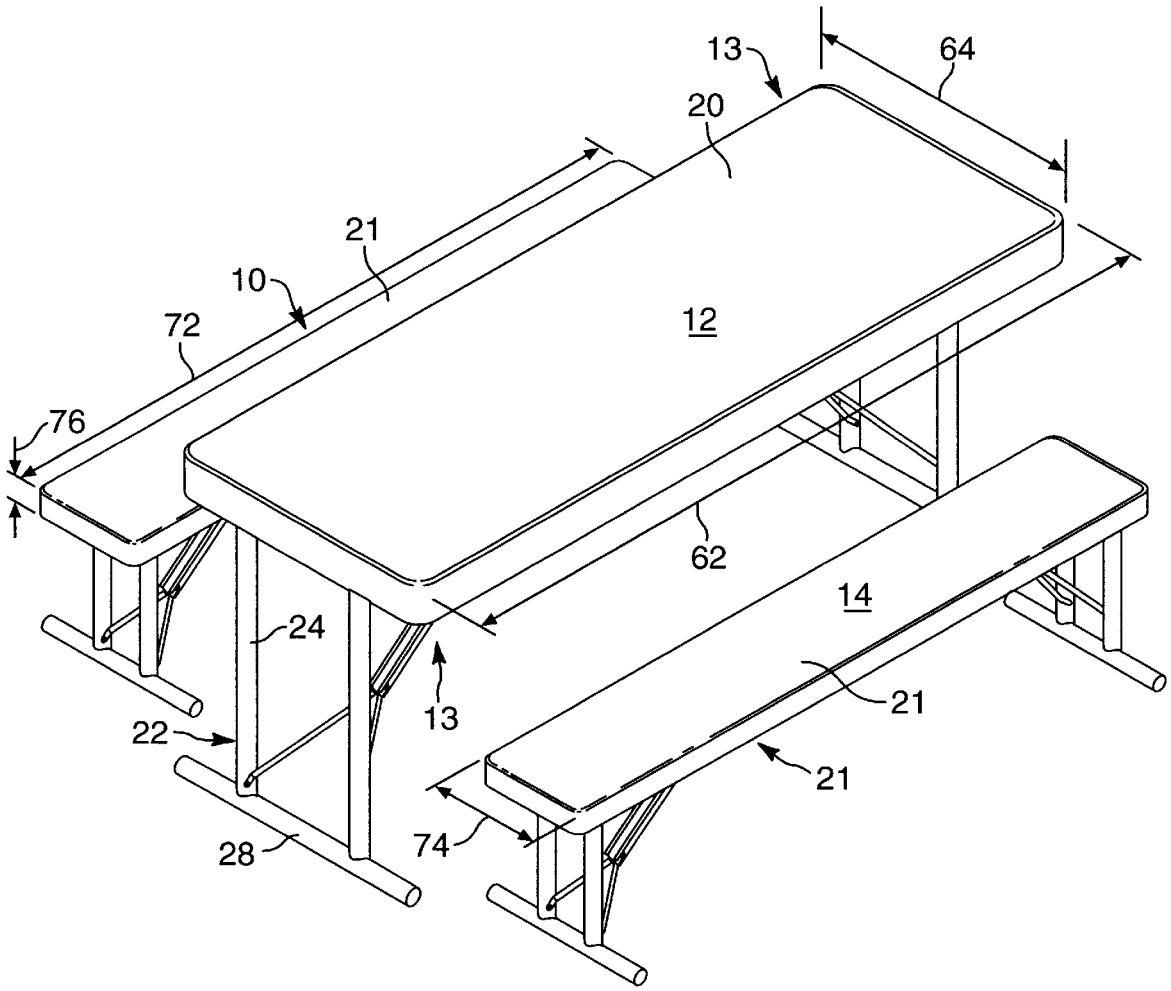
FIG. 1 is a perspective view of a table and bench system in accordance with the invention.

Referring to FIG. 1, and generally to FIGS. 1–14, an apparatus 10 may be formed to include a table 12 and a bench 14. Multiple benches 14 may be included in one presently preferred embodiment. The table 12 may be constructed to have a frame 16, and the bench 14 may have a frame 18.

In one embodiment, the principal frame 16, 18 of the table 12, bench 14, respectively may be formed of metal, such as an extrusion. However, the entire surface 20 of the table, surface 21 of the bench, and the like, may be formed as a single piece to include the respective frames 16,18 in a metal stamping. In one presently preferred embodiment, the top surface 20, 21 of the table 12, bench 14, respectively may be formed of expanded metal. In another alternative embodiment, a reinforced, crimped, solid sheet may be used, stiffened with proper changes in section modulus by corrugation, and the like.

In certain embodiments, the top surface 20, 21, of the table 12, bench 14, respectively may be formed of wood, with a metal rail as the frame 16,18, respectively. In one presently preferred embodiment, the entire frame 16 of the table 12, along with the surface 20 may be formed of a resin, by blow-molding, vacuum-forming, tumble-molding, or the like. Similarly, the bench 14, and more particularly the frame 18 and top surface 21, may be formed by any of the same methods. The table 12 and bench 14 need not be manufactured by the same process.

However, as a practical matter, lightweight plastic structures may be formed to render the table 12 and benches 14 readily transportable. Inasmuch as an easy deployment is desirable, and a simple collapse and storage is desirable, for any table 12 and bench 14, plastic resins are to be preferred in certain embodiments. Moreover, minimizing the number of persons required and the strength required of a person in order to deploy and collapse a table 12, bench 14, or both, is very desirable. Therefore, hollow structures may be preferred, and may be more readily available by such forming methods as stamping of metals, vacuum forming of resin sheets, blow-molding of hollow structures, and tumble-molding of complex, hollow structures.

In one presently preferred embodiment, a pedestal 22 may support a table 12. A pedestal 22 at each end, or close by may be formed of legs 24 or a single leg 24. To maximize strength, maximize stability, while minimizing weight, legs 24 may be spaced apart and two or more may be used. The leg 24 may be pivoted at an axle 26 securing the legs 24 (e.g. pedestal 22) to the table 12. A foot 28 may be provided to support the pedestal 22 and table 12 on a supporting surface, such as a lawn, patio, ground, floor, or the like.

As a practical matter, a brace 30 or strut 30 may be provided to selectively collapse and deploy for strengthening and stiffening the structural assembly comprising a table 12 and pedestal 22. The brace 30 may extend from the foot 28 to the table 12, or from some other location along a leg 24 and a table 12. In one embodiment, the brace 30 may be formed in multiple pieces 32,34 associated with the table 12, and leg 24 or foot 28, respectively. The brace 30 may be designed to slide along a rail 36 or stringer 36 extending along a central portion of the table 12 and extending from end to end. However, in an alternative embodiment, the brace 30 may simply break (pivot) at some intermediate point between the table 12 and pedestal 22 upon release of a lock, or upon pushing a break-over-center-type pivot from a stable, deployed position, to an unstable, collapsing position.

The frame 16,18 need not be formed to completely flat or smooth. For example, a rim 38 may be formed to extend around the entire perimeter of the table 12. The rim 38 may tend to stiffen and strengthen the overall table 12 by providing increased section modulus. Moreover, the rim 38 may also provide definition of an envelope to completely cover the nested benches 14 when collapsed and stored. In addition, the rim 38 may provide definition of the bottom of a table 12 in order to prevent persons from bumping into a bench 14 stored within the envelope of a table 12.

Benches 14 may include pedestals 42 having one or more legs 44. The pedestals 42 may extend downwardly from each end of the bench, or may be placed at a location spaced from the end of the bench 14. The legs 44 may be secured to respective axles 46 extending therethrough and secured to the frame 18 of the bench. Nevertheless, various types of fastening arrangements may be provided, commensurate with the sizes of benches 14, legs 44, pedestals 42, and the relationships thereof with the dimensions of the table 12.

In one embodiment, the legs 44 may be secured to axles 46 forming pivots 46 near the ends of the benches 14. The legs 44 may extend downward to be secured (e.g. welded, bolted, fastened, etc.) to a foot 48. The foot 48 may extend along a supporting surface to provide stability. Moreover, "floatation" may be provided in that a foot 48 may distribute stress on a supporting surface, preventing sinking of a leg 44 into the ground, for example. Also, a foot 48, particularly if formed of a right, circular, cylindrical tubing, may facilitate moving a bench 14 on a supporting surface. Similarly, a foot 28 of a pedestal 22 corresponding to a table 14 may be similarly relied upon to provide easy sliding of the foot 28 on a surface supporting the table 12. Rectangular tubing may be used to similar advantage in forming any or all portions of the pedestals 22,42.

A brace 50 may extend from a bench 14 to a pedestal 42. The brace 50 may provide stiffening, and support, similar to that provided by the brace 30 to the table 12. The brace 50 may be formed in multiple pieces 32,34 to be collapsible. Alternatively, the brace 50 may be formed to latch and release selectively along a rail 56 or stringer 56 extending along the length of the bench 14. That is, in certain embodiments, lightweight may dictate minimizing dimensions of materials in the bench surface 21 and table surface 20. Accordingly, one or more stringers 36,56 may be deployed to extend along the lengths of the table 12 and benches 14, respectively. In one embodiment, such a rail 36,56 may be formed of a worked metal piece. Alternatively, a reinforced polymeric composite may be used. In one embodiment, a deep section of the principal material from which the table 12 or bench 14 is formed may be extended to make a rail 36,56 or stringer 36,56. Thus, the brace 30,50 may be fabricated to collapse to a stored, folded condition, and to extend and lock in a deployed triangulating position stabilizing the respective pedestal 22,42. Nevertheless, a sliding arrangement may also be used, to include a key, notch, latch, or other binding mechanism to fix an end of the brace 30,50 against the rail 36,56, or against the respective table 12, bench 14, as appropriate.

The rim 38 may extend about the perimeter of the table 12 in order add section modulus, to extend the outer most fiber, in engineering terms, to a maximum distance away from a neutral axis (e.g. center with respect to the load). Similarly, the section modulus of the upper surface 20,21 of the table 12, bench 14, respectively, may be increased by adding a rim 60 extending near a top of the surface 20,21. As a practical matter, a modest boss 60 or rim 60 may be provided without discomfiting a user seated at a table.

A length 62 of an outer envelope of a table 12 may be selected to accommodate users. Certain ergonomic factors may be used to design the length 62 in order to accommodate a specific number of users. For examples, a table may be designed to provide a specific distance or space for each user, and a specific number of users. Such factors may dictate 18 inches, or 22 inches, depending on some preselected comfort factor, as a width suitable for each average person. Accordingly, the length 62 may be a multiple of a width of a theoretical single individual. The length 63 inside the table 62 may be selected to fit a bench 14 therein. A width 64 outside of a table may be selected to meet ergonomic criteria, similar to those selected for the length. For example, it is often desired that a user may be seated at one end of the table 12. Accordingly, the width 64 may be selected to accommodate a user at an end of a table 12, with out discomfiting users on each side of the table and positioned near the end.

A width 65 inside the table 12 may be selected to accommodate any hardware structures that may be required. For example, a stringer 36, whether a separate metal structure, composite, polymeric structure, wood, or the like, or an increase in the section of the table 12 itself, may be accommodated within the width 65. Similarly, the size of the benches 14 may be accommodated within the width 65 for complete nesting of the benches 14 within the envelope of the table 12.

The thickness 66 on the outside of the envelope of the table 12 may be selected to support the table by providing section modulus or stiffness. Also, the thickness 66 may be designed to accommodate the size of a user seated on a bench 14, along with the proper altitude for positioning the top surface 20 of the table 12.

A thickness 68, interior to the table 12 may be selected to contain a bench 14, the pedestal 42, thereof, and the pedestal 42 of the table 12, itself. As a practical matter, suitable legs 24,44 may be fabricated from steel tubing having an outer diameter of approximately 1 inch. In certain embodiments, the legs 24,44 may be formed along with the feet 28,48, respectively, to have a diameter of approximately 2 inches. However, for storage, compactness, and the like, additional wall thickness may be provided for each of the pedestals 22,42 in order to sustain smaller outer diameters. Thus, the height 68 of the interior cavity 69 may be selected to secure any of the hardware of the table 12 and bench 14 desired during storage, deployment, or both.

In certain embodiments, relief 70 may be formed in order to accommodate the foot 48 of a bench 14, or even the foot 28 of the table 12. Relief 70 is not required in every embodiment. Nevertheless, stability of the benches 14 and the table 12 may militate in favor of providing a maximum length 49 of a foot 48, or length 29 of a foot 28 of a table 12. A user seated on a bench 14 may push with feet, or may position oneself in a location rendering the bench 14 unstable. Thus, in one presently preferred embodiment, the length 29 of a foot 28 may be substantially greater than the width 74 of a bench 14. Thus, no weight applied to a top surface 21 of a bench 14 could provide a moment, couple, torque outside the foot 28. Thus, additional stability may be provided by having a length 49 greater than the width 74.

The thickness 76 of each bench 14 may be selected to provide the proper strength and stiffness for comfortably supporting the number of users designed into the lengths 72 of the bench 14. As a practical matter, the thickness 76 may be influenced substantially by the dimension and material selected for a stringer 56, if present. Thus, a rail 56 or stringer 56 may stiffen the bench 14, minimizing the thickness 76 required of the bench 14. The length 72 and height 73 of the bench 14 may be selected to comfortably seat users. The length 72 should also be selected to fit within the length 63 inside the envelope of the table 12.

Attachment of the pedestals 42,22 to the bench 14 and table 12, respectively, may be made by a variety of methods. In one embodiment, a bracket 80 may be formed into or secured to the table 12. An axle 82 may be formed to secure a leg 24 to the bracket 80. The bracket 80 may be formed as part of the frame 16 of the table 12, or may be an isolated part, such as a metal bracket 80 secured by a fastener to the table 12. In one embodiment, an axle 82 may secure a leg 24 into a bracket 80 with a nut 84 securing the axle 82 into the bracket 80. A pivot 86 may be provided on a rail 36 or stringer 36. Similarly, one or more pivots 88 may be provided on a leg 24 or pedestal 22, including the foot 28. The brace 30 may be shorter if connected only between a leg 24 and the table 12. The brace 30 may be substantially longer, but provide increased leverage if connected from the foot 28 to the table 12. As discussed, the pivot 86 positioned at the table 12 or on the rail 36 may be made to slide along the rail 36, or may be fixed at a single location. In one embodiment, a pivot 88 may be secured at one or more points to a leg 24 or legs 24. Meanwhile, the brace 30 may break at a pivot 90 in order to collapse and fold against a table 12 or over a rail 36.

In one embodiment, ears 92 may be formed to secure the brace 30 to the pedestal 22, the rail 36, or the table 12. A clevis-type arrangement may be desirable in order to provide suitable clearances. Alternatively, close clearances and tolerances may provide riveted pivots 90,86,88, dispensing with any separate ears 92,94. For example, method bending techniques may provide a brace 30 formed entirely by stamping steel sheets into an appropriate cross-section for stiffness, strength, and the like. Ears, attachment points, apertures, and the like, may be provided in similar stamping operations by punch presses, bending brakes, and the like.

Referring to FIGS. 2–5, and generally to FIGS. 1–14, a table 12 may be formed to nest benches 14 within the envelope thereof. For example, in FIG. 2, the underside of a table 12 and corresponding benches is illustrated.

Figure 2:
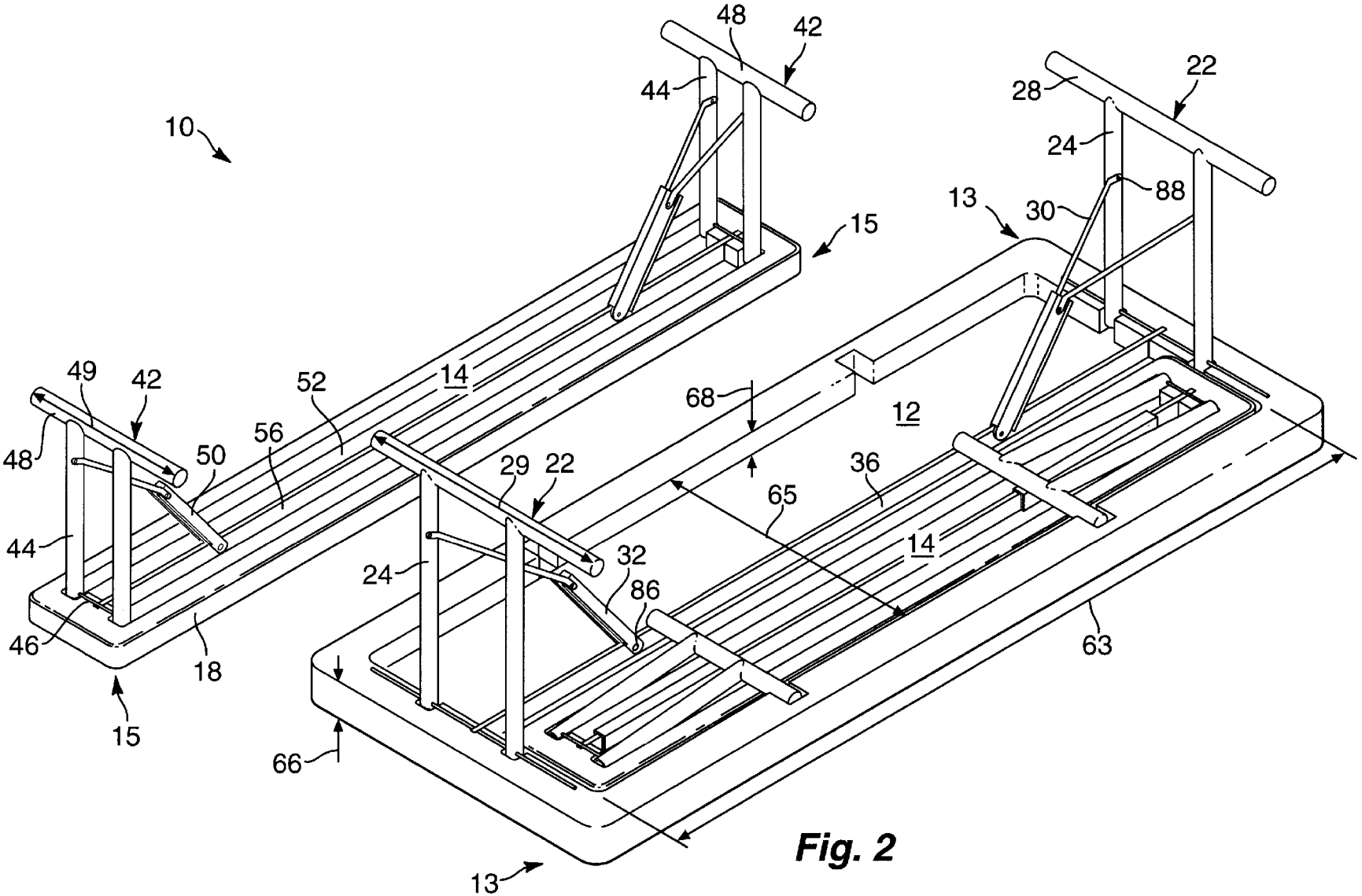
FIG. 2 is a perspective view of the underside of a table and bench system in one embodiment in accordance with the invention.
Figure 3:
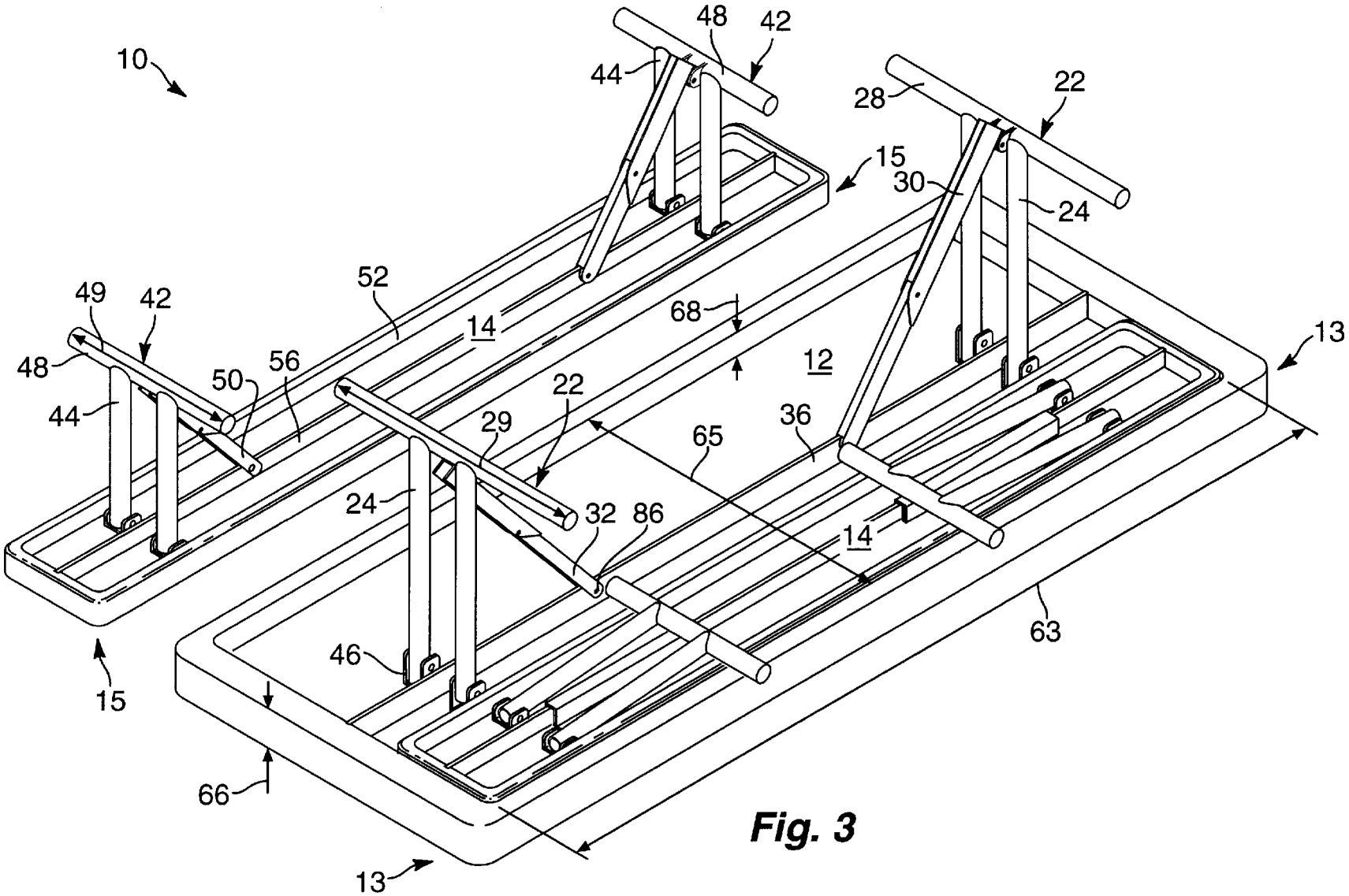
FIG. 3 is a perspective view of the apparatus of FIG. 2, partially collapsed and nested.

The benches 14 are designed to nest within one or more cavities 69 within the envelope of the table 12. In FIG. 2, the view of the underside of the table 12 and the benches 14 illustrates the collapsible pedestals 22,42. In FIG. 3, benches 14 are positioned within the cavities 69 of the table 12. One bench 14 has already been collapsed, while one still has pedestals 42 extending away therefrom.

Figure 4:
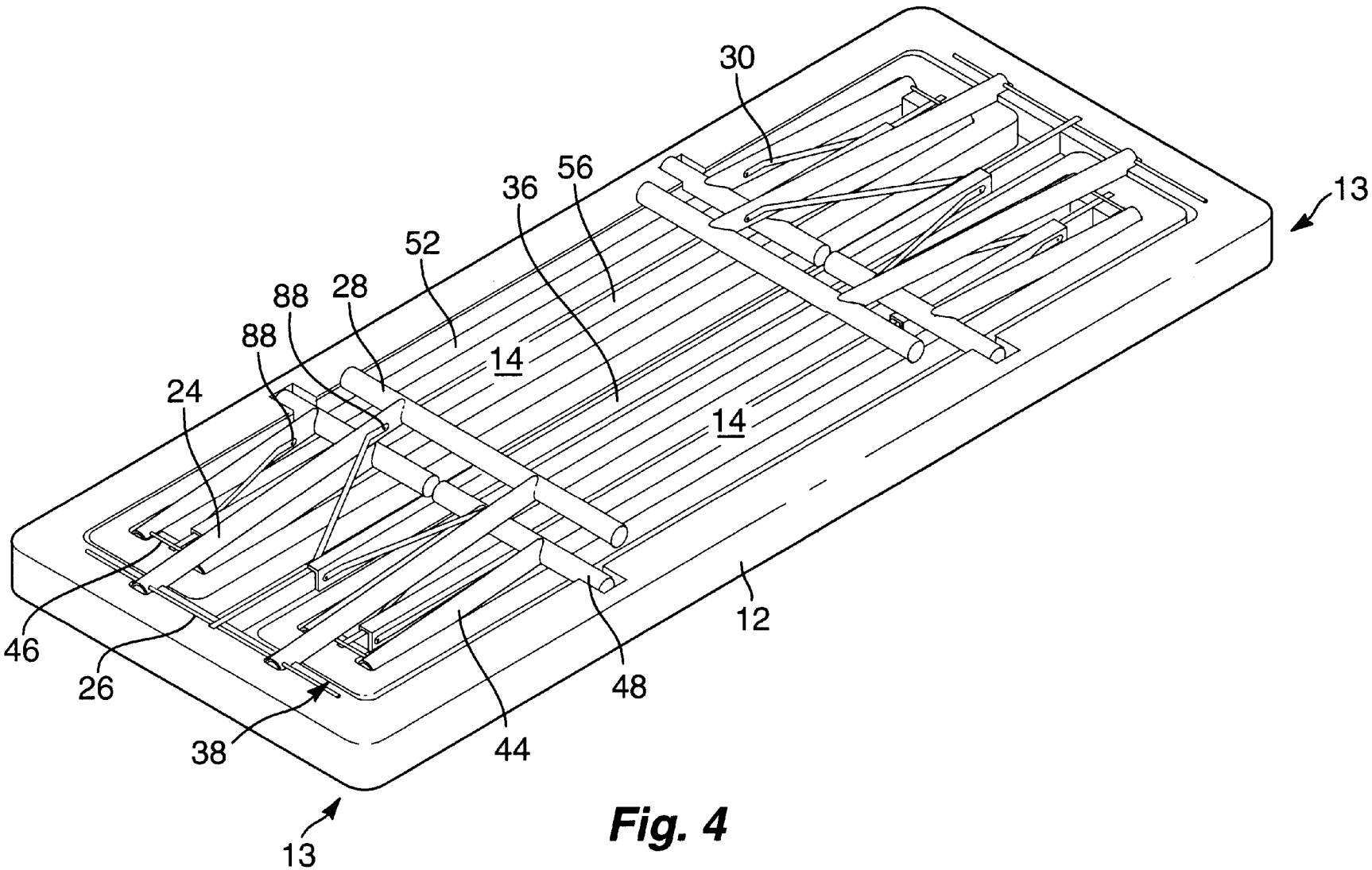
FIG. 4 is a perspective view of the apparatus of FIGS. 2–3 in a collapsed and nested configuration.

Referring to FIG. 4, the pedestals 42 of both benches 14 are collapsed beneath (depending upon one's perspective) the collapsed pedestals 22 of the table 12. The entire pedestals 22,42 and benches 14 may be fit within the envelope of the table 12. In one alternative embodiment, the benches 14 may fit within the envelope of the table 12, but the pedestals 22 of the table 12 need not. That is, having benches 14 nesting within a table 12 during use of the table 12 without the benches deployed, may require that the benches 14 not extend as obstructions beneath the table 12. However, since the table pedestals 22 are deployed anytime the table 12 is in use, not every embodiment of the table 12 need require the pedestals 22 to fit within the envelope of the table. As a practical matter, one may think of the envelope of a structure as the shape that would be taken by an elastic band completely encircling the object in question. Thus, a table top 20, may define a straight line portion of an envelope. The size and shape of the frame 16 may define another portion of the envelope of a table 12. If the pedestals 22, 42 nest completely within a table, then a straight line extending across the frame 16 of the table 12 may define another edge of the envelope of the table 12.

Figure 5:
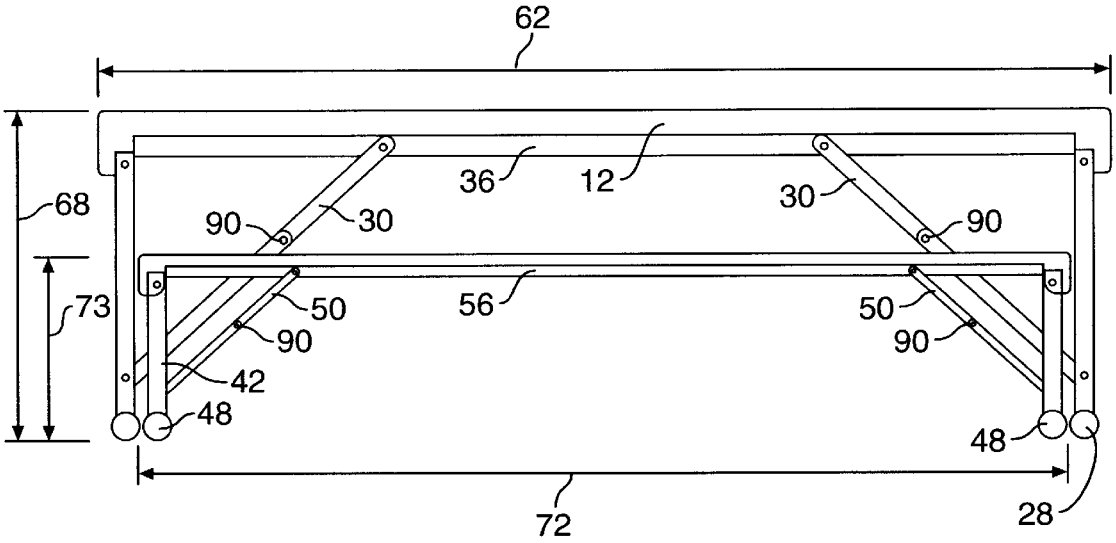
FIG. 5 is a side elevation view of the apparatus of FIGS. 2–4 illustrating one embodiment of positioning and bracing of legs and supporting surfaces.

Referring to FIG. 5, a table 12 and bench 14 are illustrated in a side elevation view. The collapsible struts 30,50 or braces 30,50 are illustrated with corresponding pivots 90. The brace 30,50 may be made to pin or slide and latch along the respective rails 36,56, or may be made to brake and lock selectively in order to triangulate the respective pedestals 22,42.

The length 72 of the bench 14 is designed to fit within the cavity 69 on the underside of the table 12. The height 68 of the table 12 may be on the order of 30 to 34 inches high in one presently preferred embodiment. The height 73 of the bench 14 may be approximately 20 inches. The overall length 62 of the table 12 may be 6 feet or 8 feet, in various, alternative embodiments. In one embodiment, the table length 62 may be 4 feet. The width 74 of each bench 14 may be 12 inches or more. If the overall width 64 of the table 12 is approximately 30 inches, then the overall width or length 29 of each of the feet 28 of the benches 14 may be selected to be approximately half the width 64, or actually half the interior width 65 of the table 12 if relief 70 is provided within the frame 16 of the table 12 in order to receive the feet 48 of the benches 14, then the overall length 49 of the feet 48 of the benches 14, may be, nominally, half the full outside width 64 of the table 12, approximately 15 inches. Thus, in one embodiment, a foot 48 may have a length 49 of 15 inches, with a width 74 of the seat 14 or bench 14 of 12 inches, providing additional stability. Extensions may be provided for the feet 48, for extending outwardly in order to preclude tipping of the benches 14. Alternatively, the feet 48 may be offset somewhat, rather than centered, in order to provide more of a foot 48 extending behind a user.

Figure 6:
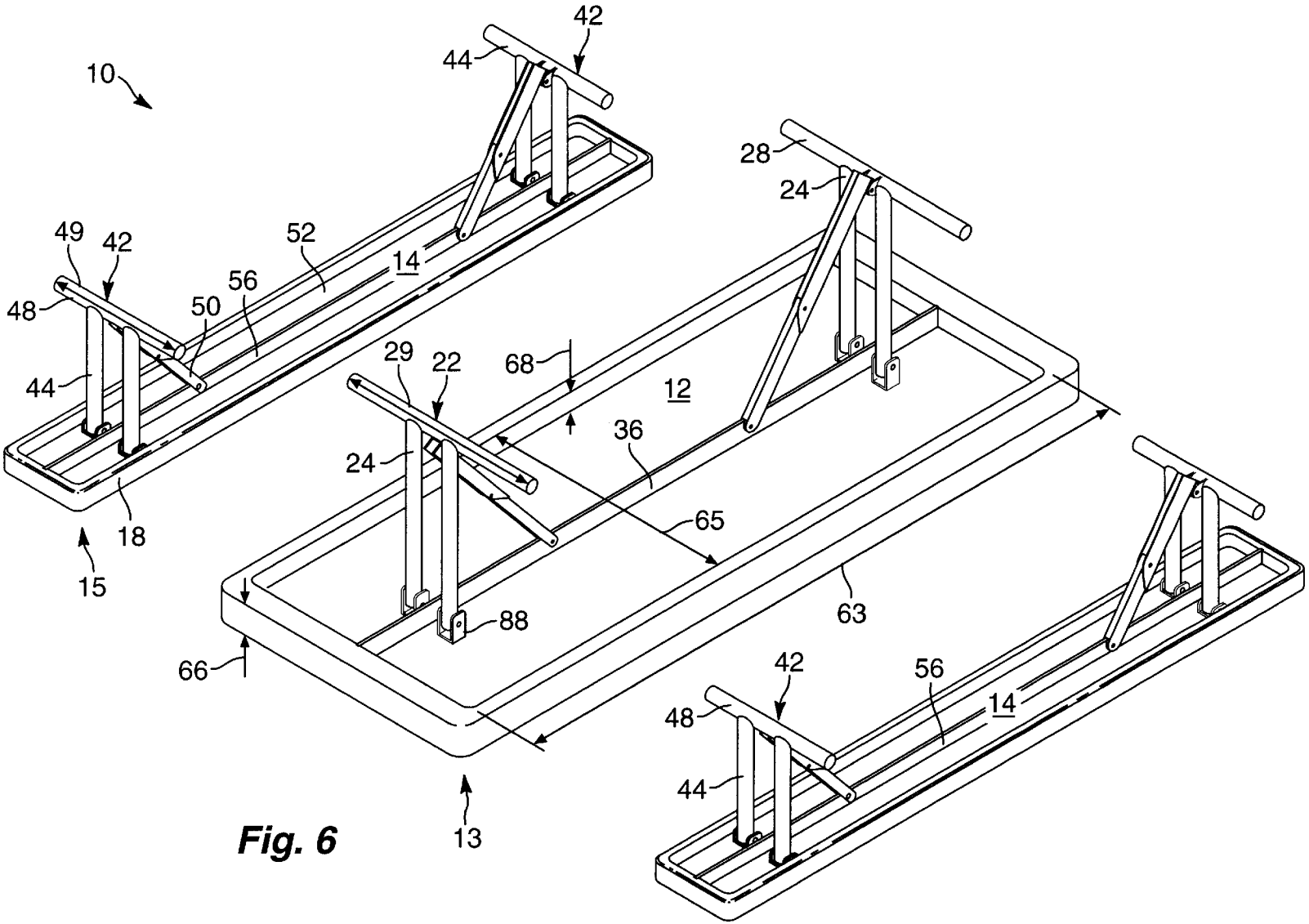
FIG. 6 is a perspective view of an underside of an alternative embodiment of an apparatus in accordance with the invention, having the pedestals spaced from the ends of the benches and tables.
Figure 7:
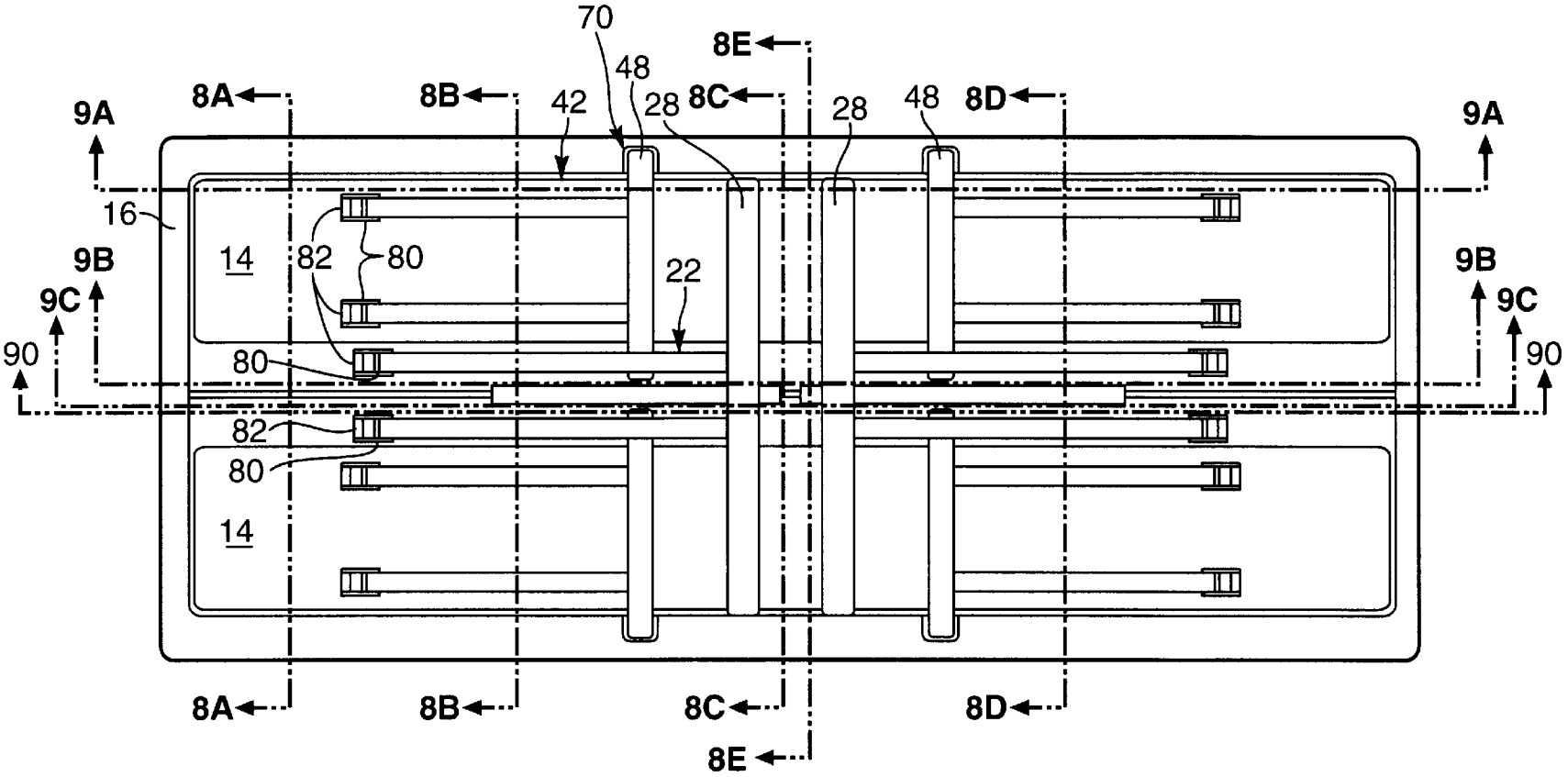
FIG. 7 is a bottom plan view of the apparatus of FIG. 6 illustrating a nested and collapsed arrangement.

Referring to FIG. 6, and generally to FIGS. 6–9, while continuing to refer in general to FIGS. 1–14, an alternative embodiment of a table 12 and benches 14 may position the pedestals 22,42 away from the end or ends 13 of the table 12. In one embodiment, brackets 80 may secure axles 82 throughout legs 24. Thus, the braces 30 may more easily be extended to contact one another near the center of the table 12. Nevertheless, with a rail 36 stiffening a table 12, the braces 30 may connect directly in a pivotable fashion to the rail 36 as discussed above. The table of FIG. 6 may be collapsed with each of the benches 14 nested within the cavities 69 of the table 12 as illustrated in FIG. 7.

Referring to FIG. 7, a bottom plan view of the table 12 and benches 14 of FIG. 6 is illustrated in a collapsed and stored position. In one particular embodiment, each of the pedestals 22,42 may pivot about axles 82 in a bracket 80 (see FIG. 3 and FIG. 12) to pivot downward to the table 12. The pedestals 42 of the benches 14 may collapse first. Relief 70 may be provided for receiving the feet 48 into the frame 16 of the table 12. In one embodiment, the pedestals 22 of the table 12 may be designed to overlap the feet 48 of the pedestals 42 of the benches 14. Thus, securement of the feet 28 and pedestals 22 of the table 12 may automatically secure the feet 48 and pedestals 42 of the benches 14.

However, in certain alternative embodiments, latches, clips, keys, detents, and the like may be provided for securing the benches 14 and pedestals 42 thereof independently from the pedestals 22 of the table 12. Thus, the benches 14 may remain secured and nested within the table 12, even while the table 12 is deployed for use.

Referring to FIGS. 8–9, while still referring generally to FIGS. 6–7, and more generally to FIGS. 1–14, various end, elevation, cross-sectional views are illustrated along with side, elevation, cross-sectional views of various embodiments of an apparatus 10 in accordance with the invention. Referring to FIG. 8*a,* a bench 14 may be nested within a cavity 69 of a table 12. The benches 14 may fill the entire cavity 69, or may fill less than the cavity 69. A rail 36 may be an independent structure or may be a mirror extension of the table 12.

Figure 8A:
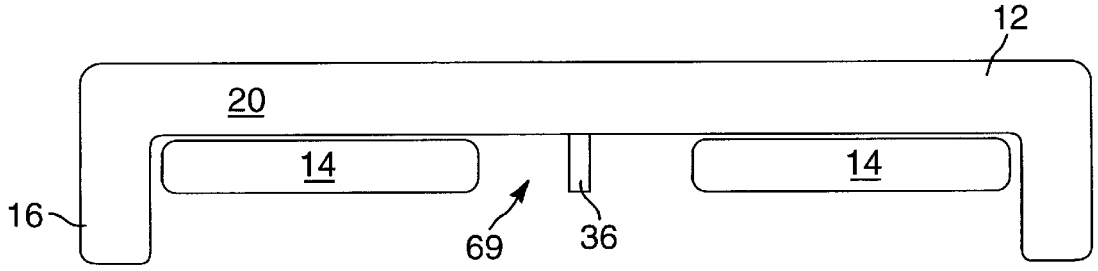
FIGS. 8A–8E illustrate end, elevation, cross-sectional views of an alternative embodiment of an apparatus in accordance with the invention and more particularly adaptable to the apparatus of FIG. 7.
Figure 8B:
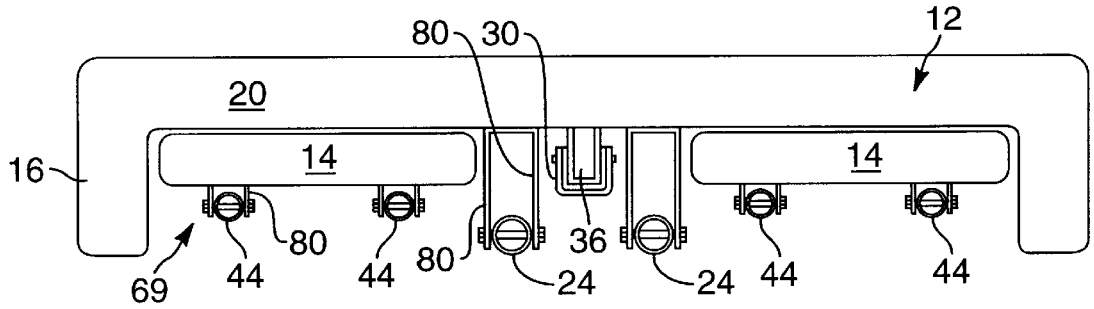

Referring to FIG. 8B, the brackets 80 may be secured to the table surface 20, referred to generally here as the entire table top 20, rather than simply the actual top surface. The table top 20 may be stiffened by the rail 36, and the brackets 80 may extend a distance away from the table top 20 and bench top 21 sufficient to permit the respective pedestals 22,42 or legs 24, 44 to pivot appropriately.

Figure 8D:
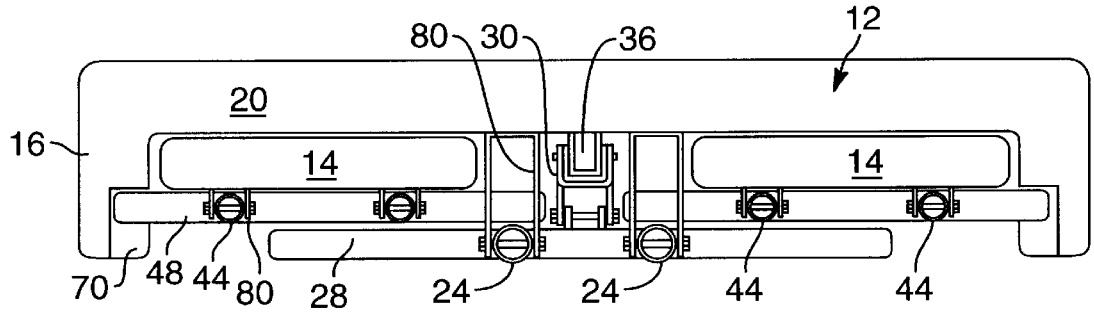

Referring to FIG. 8D, the feet 28 of the table 12 may extend a distance suitable for supporting the table top 20 stably. The overall length 29 of the foot 28 of the pedestal 22 may extend the entire inner width 65 or outer width 64 of the table top 20 of the table 12. Relief 70 may be provided for receiving the feet 48 of the benches 14, the feet 28 of the table 12, or both. The relief 70 may extend to the outermost width 64 of the table top 20. Nevertheless, as illustrated in FIGS. 8-D, and 8-E, the relief may leave the frame 16 intact for appearances, additional structural strength or other functional purposes.

Figure 8C:
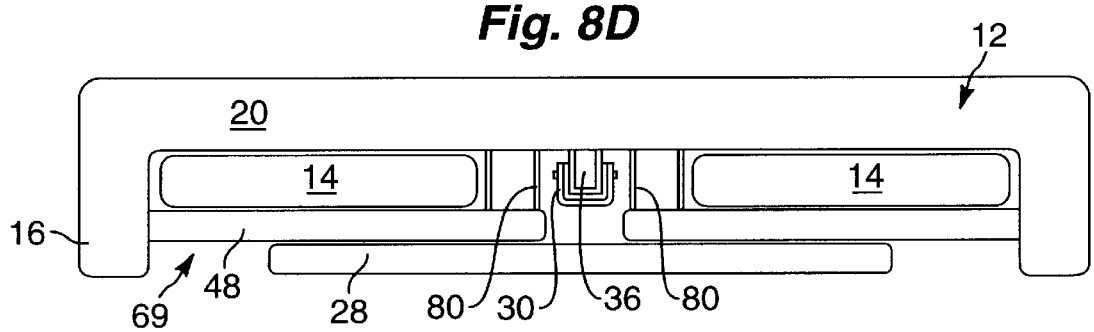
Figure 8E:
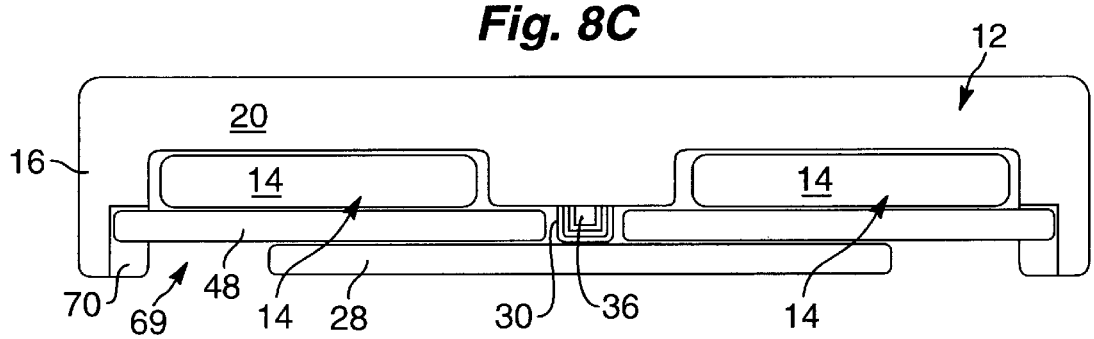

Referring to FIG. 8C, one alternative embodiment of an arrangement of the benches 14 nested completely within the envelope of the table 12, along with the entire pedestals 48 of the benches 14 and the pedestals 28 of the table 12 are illustrated. Referring to FIG. 8E, the shape of the table top 20 may be formed by injection molding, vacuum forming, tumble molding, or reaction injection molding, or the like in order to provide a more complex cross-section. Accordingly, the bench tops 21 of the benches 14 may be snugly fitted to the interior cavity 69 of the table top 20. Alternatively, the overall width 74 of each bench top 21 may consume approximately half of the overall interior width 65 of the cavity 69 of the table top 20.

Referring to FIGS. 9A–9D, while continuing to refer to FIGS. 7–8, as well as referring generally to FIGS. 1–14, a side, elevation, cross-sectional view of certain alternative embodiments of an apparatus 10 in accordance with the invention are illustrated. The table top 20 and the frame 16 may be formed to completely receive the pedestals 28,48 of the table 12 and benches 14. The entire bench tops 21 along with their respective pedestals 48 may fit within the cavity 69 of the table 12 or table top 20. Relief 70 may be provided for the feet 28 of the pedestals 22, or for the feet 48 of the pedestals 42 of the benches 14.

Figure 9A:
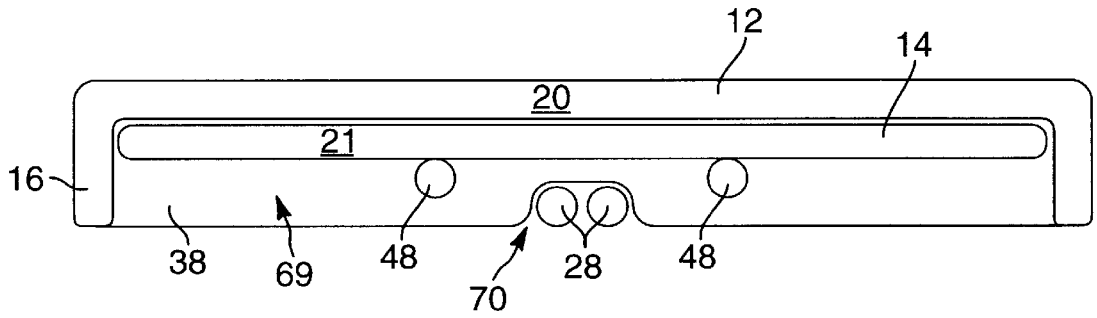
FIG. 9 is a side elevation cross-sectional view of the apparatus of FIG. 7.
Figure 9B:
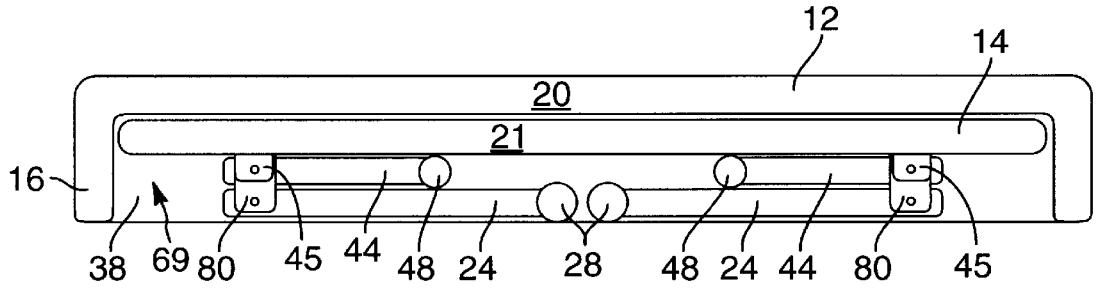
Figure 9C:
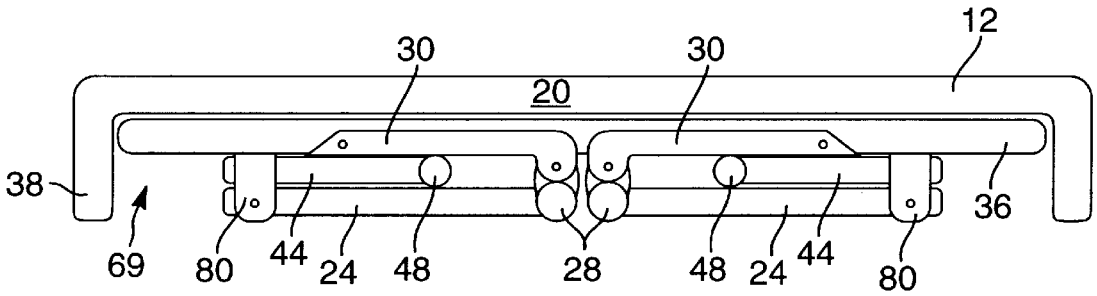

Referring to FIG. 9C, the braces 30 may be seen in one embodiment to be formed to wrap around the rail 36 or stringer 36 extending along the length 62 of the table 12. The brackets 80 may be formed in any suitable fashion to fit the geometry of the respective pedestals 24, 44, and the shape of the table top 20 and bench tops 20 desired.

Figure 9D:
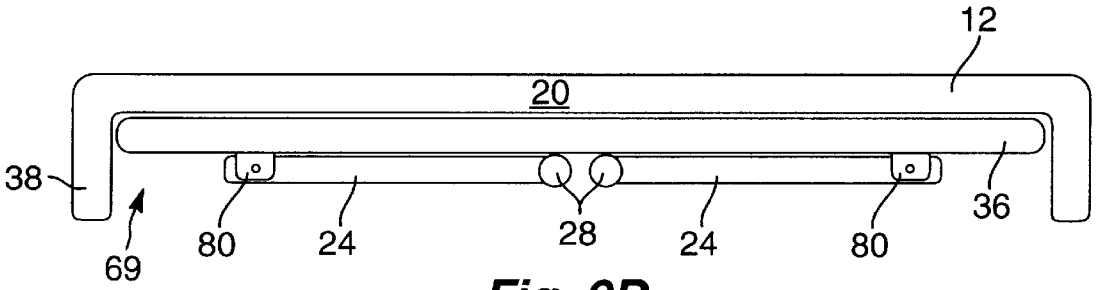

Referring to FIG. 9D, an alternative embodiment of the rail 36 may simply be an extended depth of the cross-section of the table top 20. Thus, the rail 36 merely becomes a particularly thick section of the table top 20. The size of the brackets 80 may be reduced since extension away from the table top 20 need not be so extensive.

Figure 10A:
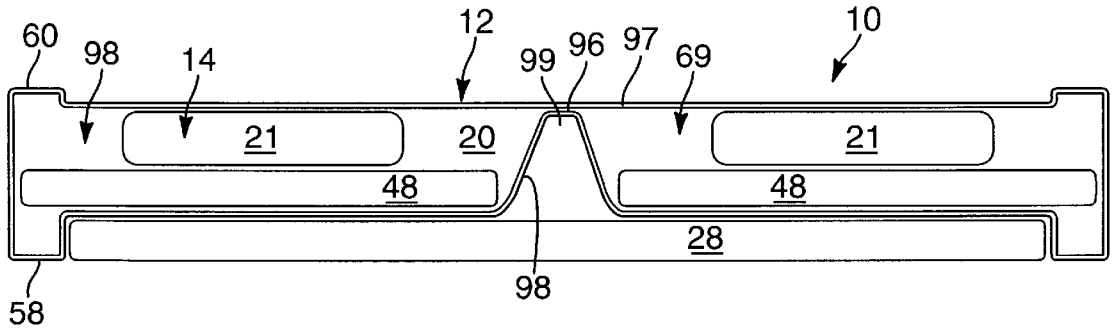
FIG. 10A is a an end, elevation, cross-sectional view of an alternative embodiment of a table and bench system in accordance with the invention, relying on a hollow table top that may be blow-molded or tumble-molded.
Figure 10B:
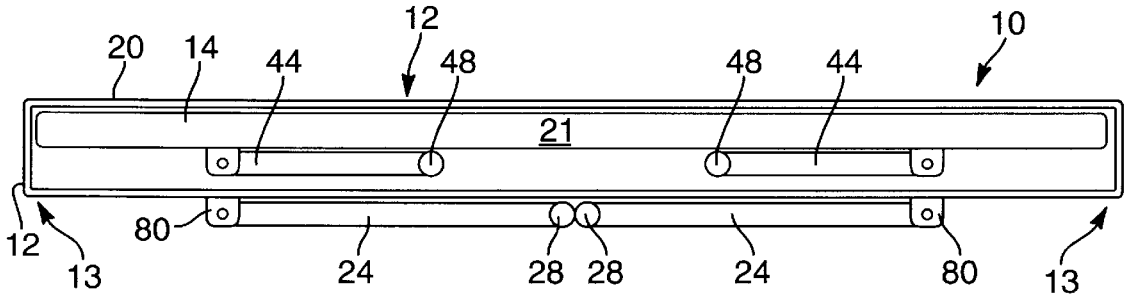
FIG. 10B is a side, elevation, cross-sectional view of an alternative embodiment of an apparatus in accordance with the invention, consistent with FIG. 10A, and FIG. 10C.
Figure 10C:
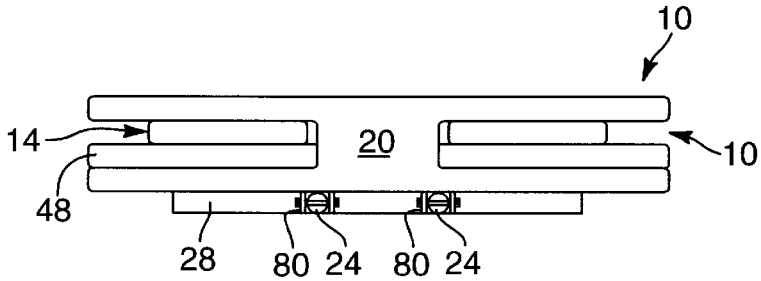
FIG. 10C is an end, elevation, cross-sectional view of one alternative embodiment of a table and bench system in which the benches are nested within a side cavity of a table.

Referring to FIGS. 10A–10C, certain alternative embodiments for an apparatus 10 in accordance with the invention are illustrated. In the illustration of FIG. 10A, an alternative embodiment of an apparatus 10 is illustrated in an end, elevation, cross-sectional view. In this embodiment, a table top 20 may be formed to be hollow. Such a formation may be completed successfully using blow-molding, vacuum forming, tumble molding, and the like. As a practical matter, the table top 20 may be formed to provide a hollow for receiving the benches 14. The hollow cavity 69 or cavities 69 may be formed in the table top 20 for receiving the benches 14. In one embodiment, a weld 96 may secure a top surface 97 to a riser 98 for stiffening the table top 20. A cavity 99 may result which may then support and receive, for example the brace 30. Moreover, the riser 98 may act as the rail 36 adding stiffness by increasing the section modulus of the table top 20. The dimensions of the cavity 99 may be selected for structural and spatial considerations in strengthening the table top 20 and in receiving the benches 14.

In the embodiment of FIG. 10A, the benches 14 may slide directly into an end 13 of a table top 20. End caps may optionally be provided for hiding the benches 14 and stiffening the tabletop 20. A rim 58 may extend downwardly, while a rim 60 may provide a boss 60 or rise 60 for stiffening the overall top surface 12. The top surface 12 and the pedestal 98 may actually be formed in separate operations, such as by vacuum forming to be sealed, welded, bonded, or otherwise fastened together. Alternatively, the entire structure of the table top 20 may be formed by blow molding or tumble-molding to form a strong, stiff, consistent structure having cavities adapted to receiving the benches 14.

Referring to FIGS. 10B–10C, side, a elevation, sectioned view is illustrated with an end, elevation, cross-sectional view of a table top 20 and benches 14. In one embodiment, the pedestals 24 corresponding to the table 12 may be secured outside the envelope of the table top 20. Meanwhile, the benches 14 may be stored in slots formed in the sides of the table top 20. As a practical matter, the apparatus 10 of FIGS. 10B–10C may be provided with caps for sealing the cavities 69 for aesthetic purposes. An advantage of the apparatus 10 of FIGS. 10B–10C is the improved section modulus and result of stiffness in flexure viewed from end to end 13 of the table.

Figure 11:
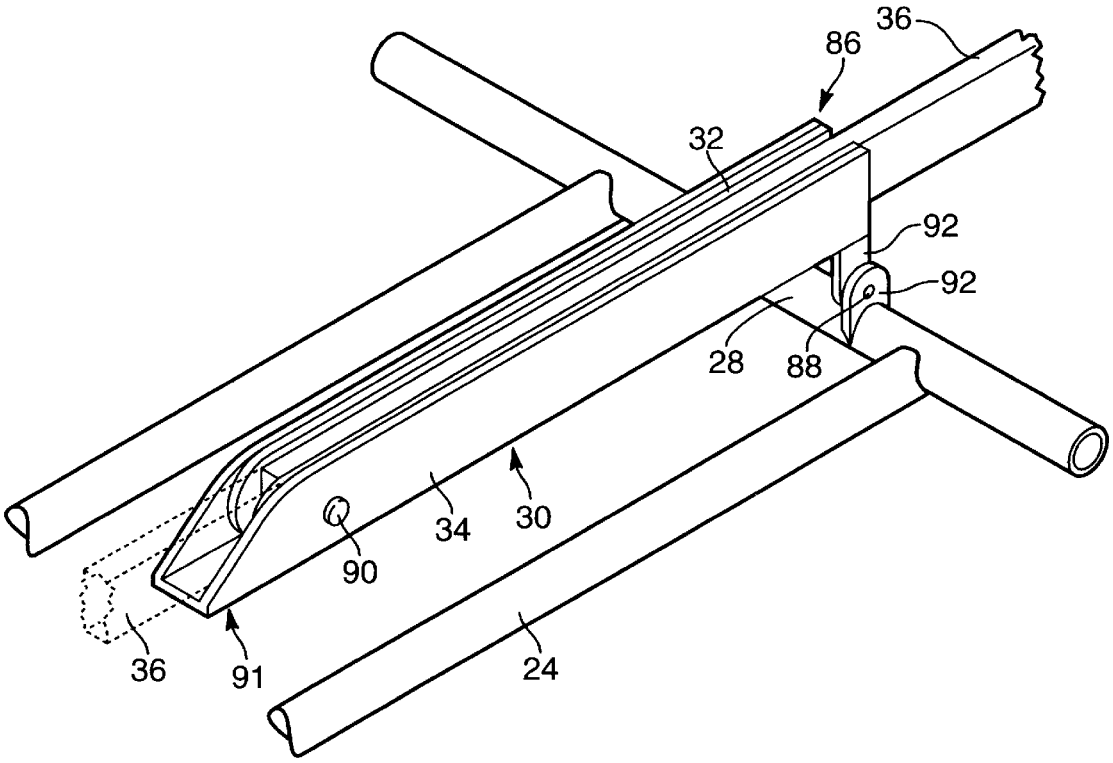
FIG. 11 is a perspective view of one alternative embodiment of a self-stabilizing collapsible brace or diagonal for supporting a bench or table pedestal.

Referring to FIG. 11, a brace 30 may be formed to nest about the rail 36. The brace 30 may also be used as a brace 50, and may accommodate a rail 56 for the bench 14. As a practical matter, pivots 86,88,90 may be provided for breaking the brace 30 into a lower piece 34 associated with the pedestal 24,44, and an upper piece 32 associated with the table top 20 or rail 36. Correspondingly, the upper piece 32 in a brace 50 may correspond to a rail 56 or stringer 56 of a bench 14, or simply a bracket 80 attached to a bench top 21. Meanwhile, the lower piece 34 may be one or more pieces, and may be a rail 34, a yolk 34 into two pieces 34, or the like as described and illustrated above, for securing the upper piece 32 to legs 24,44 or foot 28,48 of the respective table 12 or bench 14. The pivots 90,88,86 may be formed in any one of several suitable manners. In one embodiment, a rivet may be secured to a surface, and left to pivot within an aperture in another surface. Thus, the pivots 86,88,90 may be made virtually flush with the surfaces of the pieces 32,34.

A lock, or stabilizer 91 may support the pieces 32,34 with respect to one another and stabilize them with respect to one another. Various mechanisms known in the art are available for locking the pivot 90 to form a rigid brace 30,50 made of the upper piece 32 and lower piece 34.

Figure 12A:
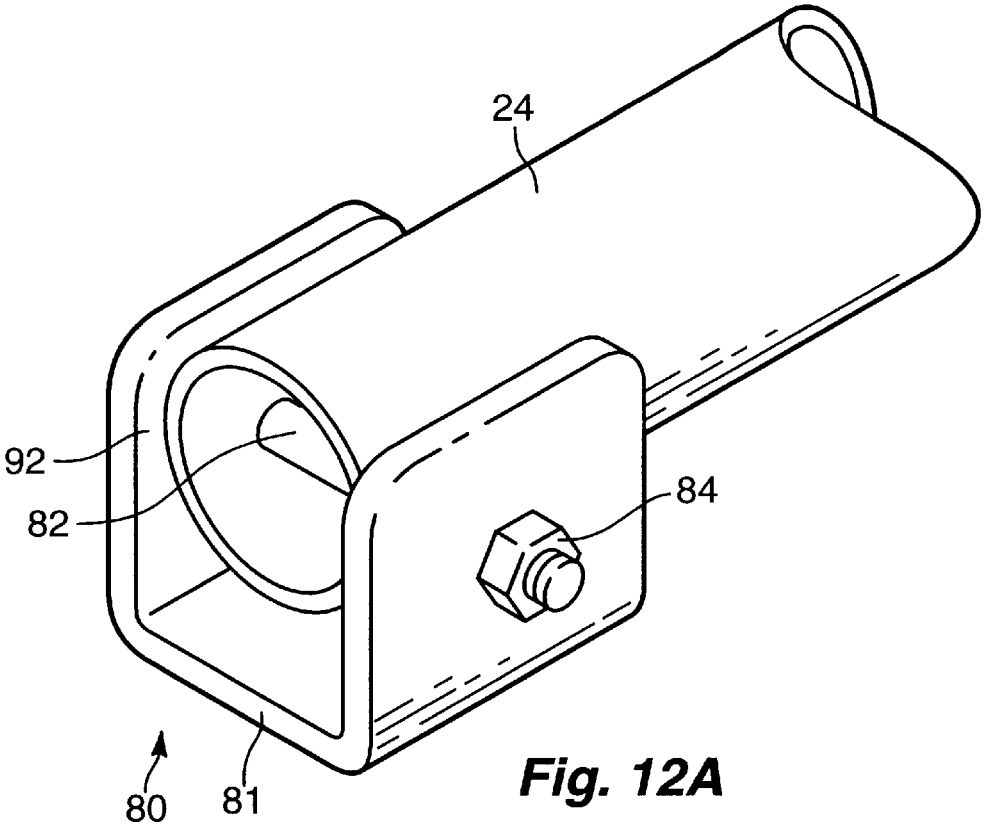
Figure 12B:
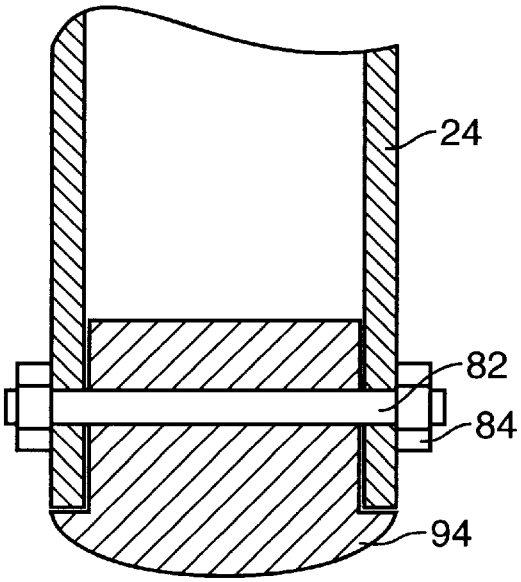

Referring to FIG. 12, a bracket 80 may include a mount 81 or mounting surface 81 for securing to a table 12 or bench 14, such as a table top 20 or bench top 21. Ears 92 or a clevis 92 may be formed to receive an axle 82. The axle 82 may be secured by a rivet head or nut 84 or other securement structure 84. A leg 24 may extend into the bracket 80 between the ears 92 or levis 92. Accordingly, a leg 24,44 may pivot about an axle 82 as desired. A brace 30,50 may secure a leg 24,44 of a table 12 or a bench 14. In the illustration of FIG. 11, the ears 92 or clevis 92 may be secured with a pivot 88 to a foot 28 of a pedestal 22. Nevertheless, the brace 30,50 may be secured as one or two pieces directly to the leg 24 or legs 24,44 of the table 12 or bench 14, respectively.

Referring to FIGS. 13A–13D, while continuing to refer generally to FIGS. 1–14, numerous mechanisms may be embodied for securing the bench top 21 or bench 14 within the envelope of the table top 20 or table 12. In one embodiment, a detent 100 may be formed to capture each side of a bench top 21 or bench 14. The detents 100 may be formed in the table top 20 as ledges or the like to be deformable to deflect sufficiently to receive the bench top 21 or entire bench 14, closing in therebehind to secure the bench top 21 or bench 14 with in the cavity 69. Each of the views of FIGS. 13*a*–13*d* represents a partial, cutaway, end, elevation, cross-sectional view of a table top 20 of a table 12 and a bench top 21 of a bench 14. The interference 104 of the detent 100 with the bench top 21 provides the latching mechanism. Nevertheless, application with suitable force, greater than the weight of the bench 14 may dislodge the bench top 21 or bench 14 by deforming the detents 100 sufficient to neutralize the interference 104.

Figure 13A:
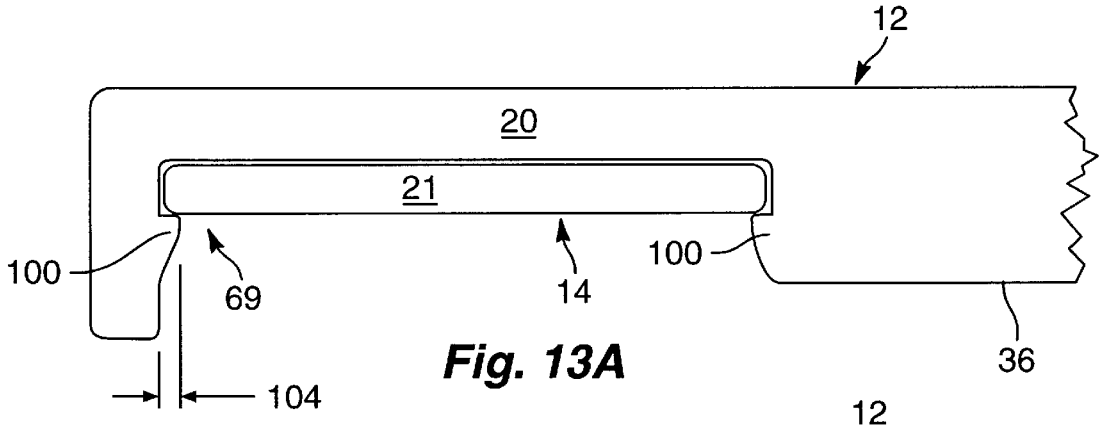
FIGS. 13A–13D are end, elevation, cross-sectional views of alternative embodiments for securing the bench within the table envelope.
Figure 13B:
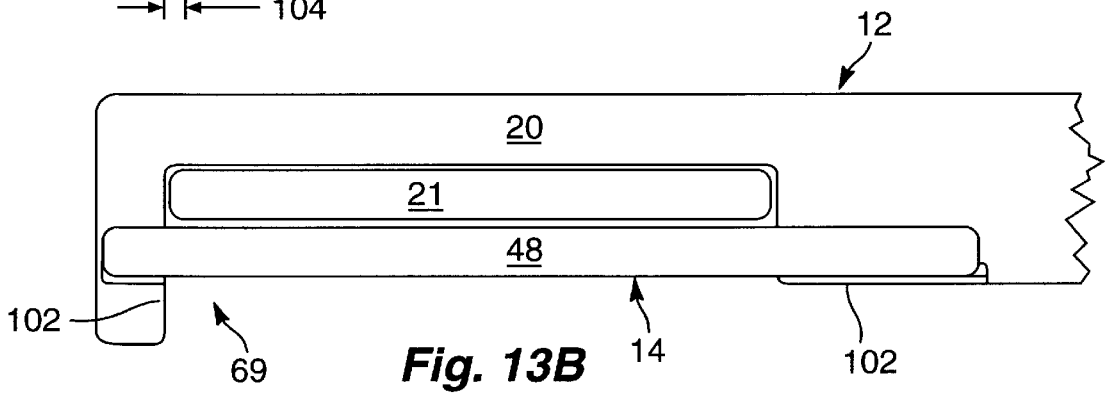

Referring to FIG. 13B, detents 102 may be formed in the frame 16 of the table top 20 for receiving the foot 48 of a bench 14. Detents 102 may be formed near the outside or inside portions of a table top 20. For example, in the embodiments of FIGS. 13*a*–13*d,* the rail 36 is not a distinct metal rail necessarily, but may merely be an increased section of the table top 20. The detents 102 may act in approximately the same manner as the detents 100 may operate in an orthogonal direction.

Figure 13C:
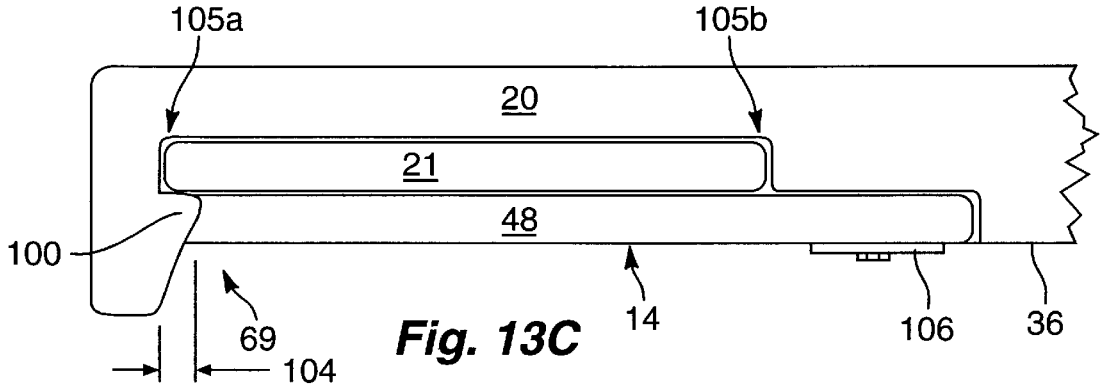

Referring to FIGS. 13C, a detent 100 may be formed to have a substantial interference 104 that cannot be deformed. Instead, placement of a bench top 21 may involve placing one side 105*a* of the bench top 21 into the cavity 69 above the detent 100. Meanwhile, the bench top may be rotated into position at an opposite side 105*b* to be received into the cavity 69. Meanwhile, some form of latch 106 or latching mechanism 106 may be adapted to secure the foot 48 or the bench top 21 in the cavity 69. Thus, the detent 100 of FIG. 13C may form a shelf such that a single latch 106 may secure a foot 48.

Figure 13D:
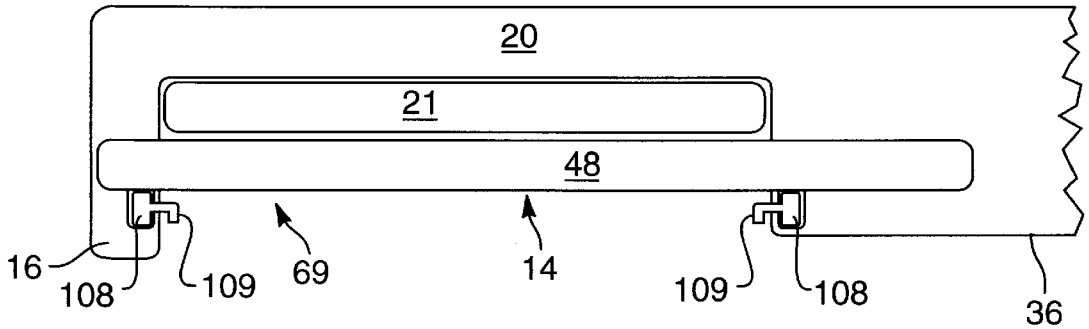

Referring to FIG. 13D, in one embodiment, a slide 108 may be used, operating similarly to a deadbolt. For example, a handle 109 may be formed to be fixed with respect to a slide 108 running in a longitudinal direction along a frame 16 of a table top 20. The slide 108 may move away from a foot 48 to release the foot, and leave the bench 14 free to removed. Meanwhile, a slide 108 may be moved to interfere partially or completely with movement of the foot 48. Thus, a bench 14 may be positively secured within a cavity 69 of a table top 20.

Referring to FIGS. 14A–14E, various types of latching mechanisms 106, 108 are illustrated. For example, a latch 106 may rotate about a pivot 107 to engage a foot 28,48. Alternatively, referring to FIG. 14B particularly, FIGS. 14A–14D generally, and continuing to refer to FIGS. 1–14, a latch 108 may be captured within a guide 109 or weigh 109 to move in a direction 111 transverse to a foot 28,48 or a leg 24,44 or even a pedestal 22,42, generally. Thus, a latch 108 may slide in a direction 111 across a foot 28,48 securing the pedestal 22,42 and bench 14 within the cavity 69 of a table top 20.

Figure 14A:
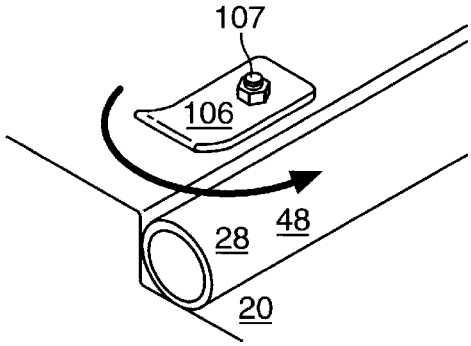
Figure 14B:
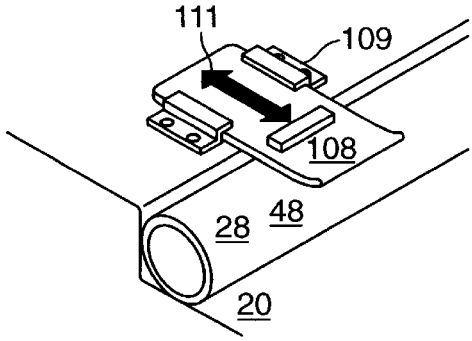
Figure 14C:
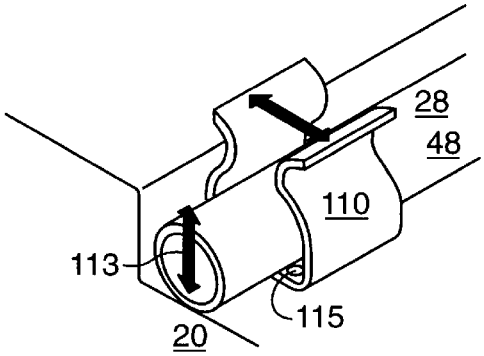

Referring to FIG. 14C, a clip 110 may be formed of a plastic, or a metal to spring away and back in response to forces applied by a user. For example, a user may apply a force in a direction 113 transverse to a longitudinal direction of a foot 28,48 in order to urge the spring clip 110 to move in a transverse direction 111. The shape of a clip 110 may be designed to be secured by fasteners 115 to a table top 20 in a desired location. Accordingly, a foot 28,48 or a leg 24,44 may be received within the clip 110 securely. Application of a suitable force by a user may open the clip 110 releasing the foot 28,48 or leg 24,44.

Figure 14D:
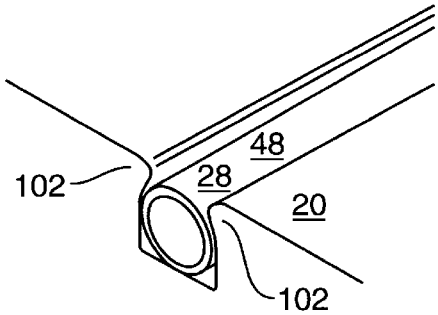

Referring to FIG. 14D, an alternative embodiment of a detent 102 is illustrated in which, the actual detent 102 is formed to operate as a clip 110 of FIG. 14C. Accordingly, the detents 102 may operate to move in a direction 111 in response to a force applied by a user in a direction 113 urging a foot 28,48 or leg 24,44 in the direction 113. Thus, the detent 102 may deflect in a direction 111 when acted upon by a user. Meanwhile, the detents 102 secure a foot 28,48 or leg 24,44 within the envelope of the table top 20.

Figure 14E:
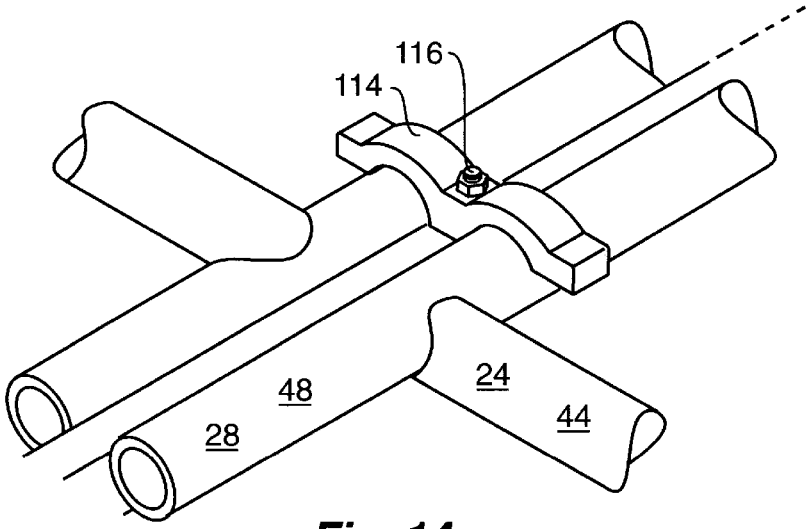

Referring to FIG. 14E, a yolk 114 may be designed to fit on a fastener 116. A fastener 116 may be spring loaded, or may be threaded or latched in some other way. The yolk 114 may be selectively turned to release and capture one or more feet 28,48 similarly, a latch 114 or yolk 114 may be designed to fit between a pair of legs 24,44 of a table 12 or bench 14. Rotation of the yolk 114 about a fastener 116 may effect extension of the fastener 116, if spring-loaded or may be ineffectual, if the fastener 116 is rigid. A rigid fastener 116 may require a wing nut or the like to release the yolk 114 a distance sufficient to rotate about the fastener 116 to selectively release or engage the foot 28,48 or leg 24,44.

In general, it may be seen that an apparatus 10 in accordance with invention may be fabricated to secure benches nested within the envelope of a table top. Meanwhile, the benches may be formed of wood, metal, plastic, and the like. A table top may be formed by any of several mechanisms from a resin (polymers) metal, or wood. In one, presently preferred, lightweight embodiment, the tables and benches may be formed of plastic in a hollow structure. The hollow structure may be filled with foam where desired, and left evacuated where desired. Double walls, single walls, and the like may be used to form the table top 20 and the bench top 21. Cavities and recesses may be formed at will within the bottom surface of the table top 20, and the bottom surface of the bench top 21. Accordingly, the legs may be accommodated with brackets 80 formed into the table top 20 and bench top 21, or may have metal or other material selected for forming brackets to be attached to a table top 20 or bench or bench top 21, respectively. In one presently preferred embodiment, an apparatus and method in accordance with the invention may be formed to be carried by a single individual. Two individuals may easily carry a nested pair of benches 14 within a table 12. The single individual may deploy the benches 14 and the table 12 once positioned in an area for use.

From the above discussion, it will be appreciated that the present invention provides a table and bench system 10, in which each bench 14 is separately deployable from the other bench 14, and from the table 12. The benches 14 are separable from one another and from the table 12. The benches 14 may be nested alone or together within the table 12. A recess formed in the table top 20 may provide for storage of the benches 14 within the overall envelope of the table top 20. The table 12 may be used with full functionality with the benches stored within the table envelope, or with the benches deployed, removed, or positioned elsewhere for other uses. The benches 14, may be separately useable without the tables, by removal from their nested locations in a cavity 69 of a table 12. The entire bench 14 is collapsible for storage. The entire table is collapsible for storage. The benches are collapsible within the table structure for storage. Nevertheless, the benches 14 and the table 12 do not require each other for any structural mechanism for support during deployment and use.

The present invention may be embodied in other specific forms without departing from its structures, methods, or other essential characteristics as broadly described herein and claimed hereinafter. The described embodiments are to be considered in all respects only as illustrative, and not restrictive. The scope of the invention is, therefore, indicated by the appended claims, rather than by the foregoing description. All changes which come within the meaning and range of equivalency of the claims are to be embraced within their scope.

What is claimed and desired to be secured by United States Letters Patent is:

1. An apparatus comprising:

a table comprising a table top and pedestals for supporting the table top above a surface;

the table top formed to present a cavity therein;

a bench sized to operate in conjunction with the table the bench comprising a bench top sized to support more than one user thereon, and a pedestal adapted to support the bench top above the surface;

the table top sized to receive therein, within the cavity, the bench; and a retainer for securing the pedestals of the table to the table top securing therebetween the bench captured between the pedestal and the table top.

2. The apparatus of claim 1, further comprising a detent selected to readily support the bench within the cavity.

3. The apparatus of claim 1, wherein the pedestals are adapted to extend proximate the ends of the table.

4. The apparatus of claim 1, wherein the bench is constructed to present a pedestal proximate each end thereof, the pedestals adapted to pivot proximate the ends of the bench for collapsing the pedestals against the bench top for storage within the table top.

5. The apparatus of claim 1, wherein the cavity is formed to extend from an underside of the table top into an envelope of the table top.

6. The apparatus of claim 1, wherein the cavity is constructed to extend from proximate one end of the table top toward an opposite end of the table top, for receiving the bench therein, the bench being inserted longitudinally within the cavity inside the table top.

7. The apparatus of claim 1, wherein the bench is separable from the table, with the pedestal of the table maintaining the table top free standing, independently from the bench.

8. The apparatus of claim 1, wherein the bench is constructed to have two pedestals, the pedestals rendering the bench freestanding, independently from the table, the bench being separable, and fully useable independently from the table.

9. The apparatus of claim 1, wherein the table and bench are constructed to render the table independently freestanding in the absence of the bench and the bench independently freestanding in the absence of the table, both the table and the bench being independently useable remotely from one another.

10. The apparatus of claim 1, wherein the table top defines an envelope, the envelope comprising a surface extending in space connecting all outer surfaces of the table top to one another continuously, and the bench is constructed to fit in a collapsed, stored position, nested within the envelope of the table top.

11. The apparatus of claim 1, wherein the bench is constructed to fit within the cavity of the table top, and the table is fully functionally useable with the bench positioned in a completely collapsed and stored position within the table top.

12. The apparatus of claim 1, further comprising another bench, and wherein the other bench is storable within the table top, and the bench and the other bench being separately selectable by a user for use, independent from one another, the bench and the other bench each being separately useable and storable.

13. The apparatus of claim 12, wherein the table, the bench, and the other bench are all independently, fully useable, independently from one another, and remotely from one another.

14. The apparatus of 13, wherein the bench, the other bench, and the table are all independently and remotely storable with respect to one another, and all completely useable and storable in conjunction with one another, and wherein such use and storage is selectable by a user.

15. The apparatus of claim 1, wherein the table is constructed to include a rail section adapted to increase the section modulus of a table top of the table for supporting a load thereon.

16. The apparatus of claim 1, wherein the bench is constructed to include a rail section adapted to increase the section modulus of the bench for supporting a user thereon.

17. The apparatus of claim 1, wherein the pedestal of the table and the pedestal of the bench, are stabilized by braces, respectively, deployable to fix the respective pedestals with respect to the table top and the bench top, and wherein the braces are each deployable by a single hand of a user.

18. The apparatus of claim 17, wherein each of the braces is formed in multiple pieces and further comprises a lock for fixing the brace as a rigid member extending away from the respective pedestal thereof.

19. The apparatus of claim 1, wherein the cavity formed on the underside of the table top is adapted to receive the bench entirely therewithin, and wherein the table top further comprises a frame extending to define an envelope, the frame providing a stiffness selected to support a load on the table top.

20. The apparatus of claim 1, further comprising a securement mechanism adapted to retain the bench within the cavity during deployment and storage of the table.

21. The apparatus of claim 20, wherein the securement mechanism is selected from a latch, a clip, a detent, a slide, and a yoke, the securement mechanism being effective to be operated by a single hand of a user for releasing a bench from securement to the table.

22. The apparatus of claim 1, wherein said table is formed of a polymeric material.

23. The apparatus of claim 1, wherein said bench is formed of a polymeric material.

24. An apparatus comprising:

a table having a table top and pedestals for supporting said table top above a surface;

said table top formed to present a cavity therein;

a bench sized to operate in conjunction with said table, said bench comprising a bench top sized to support more than one user thereon, and a pedestal adapted to support said bench top above said surface;

said table top sized to receive therein, within said cavity, said bench;

a securement mechanism adapted to retain said bench within said cavity during deployment and storage of said table; and wherein said table and said bench are constructed to render the table independently freestanding in the absence of the bench and the bench independently freestanding in the absence of the table, both the table and the bench being independently useable remotely from one another.

25. The apparatus of claim 24, further comprising a second bench sized to operate in conjunction with said table, said second bench comprising a bench top sized to support a plurality of users thereon, and a pedestal adapted to support said bench top above said surface.

26. The apparatus of claim 24, further comprising a detent selected to readily support said bench within said cavity.

27. The apparatus of claim 24, wherein said table is formed of a polymeric material.

28. The apparatus of claim 24, wherein said pedestals are adapted to extend proximate the ends of said table.

29. The apparatus of claim 24, wherein said cavity is constructed to extend from proximate one end of said table top toward an opposite end of the table top, for receiving said bench therein, the bench being inserted longitudinally within the cavity inside the table top.

30. The apparatus of claim 29, wherein said cavity is adapted to receive said bench entirely therewithin.

31. The apparatus of claim 24, wherein said bench is constructed to present a pedestal proximate each end thereof, said pedestals adapted to pivot proximate said ends of the bench for collapsing the pedestals against said bench top.

32. The apparatus of claim 24, wherein said bench is formed of a polymeric material.

33. The apparatus of claim 24, wherein said table is constructed to include a rail section adapted to increase the section modulus of said table top for supporting a load thereon.

34. The apparatus of claim 24, wherein said bench is constructed to include a rail section adapted to increase the section modulus of said bench for supporting a load thereon.

* * * * *